US005288295A

United States Patent [19]

Hypes et al.

[11] Patent Number: 5,288,295

[45] Date of Patent: Feb. 22, 1994

[54] CEMENT KILN FUELS CONTAINING SUSPENDED SOLIDS

[75] Inventors: Ron Hypes, Foster City; Peter Morton, East Palo Alto, both of Calif.

[73] Assignee: Romic Chemical Corporation, East Palo Alto, Calif.

[21] Appl. No.: 15,261

[22] Filed: Feb. 8, 1993

Related U.S. Application Data

[63] Continuation of Ser. No. 738,303, Jul. 31, 1991, abandoned.

[51] Int. Cl.[5] ..... C10L 1/32

[52] U.S. Cl. ..... 44/301; 44/300

[58] Field of Search ..... 44/301, 300

[56] References Cited

U.S. PATENT DOCUMENTS 3,659,786 5/1972 Vier ..... 110/346

FOREIGN PATENT DOCUMENTS 56-159291 12/1981 Japan .

57-111388 7/1982 Japan .

59-81386 5/1984 Japan .

2036072 11/1979 United Kingdom .

OTHER PUBLICATIONS

CRC, *Handbook of Chemistry and Physics*, 51st Edition, 1970-71, pp. F-224-F-225.

*Primary Examiner*—Prince Willis, Jr.
*Assistant Examiner*—James Silbermann
*Attorney, Agent, or Firm*—Limbach & Limbach

[57] ABSTRACT

A fuel comprised of liquid and solid refinery waste streams is described. The fuel is a blend of a heavy paraffinic oil, an emulsified waste oil, water and solids. The fuel is blended both to achieve a viscosity which enables the fuel to be pumped, and to obtain the required fuel value for burning in a cement kiln while simultaneously having a high solids content. The amount of the heavy paraffinic oil present in the final fuel is related to the ambient temperature at which the fuel is to be pumped, stored and consumed. Typically, the higher the ambient temperature the more heavy paraffinic oil that can be used in the fuel blend.

9 Claims, 1 Drawing Sheet

CEMENT KILN FUELS CONTAINING SUSPENDED SOLIDS

This is a continuation of co-pending application Ser. No. 07/738,303 filed on Jul. 31, 1991, now abandoned.

TECHNICAL FIELD

This invention relates generally to fuels derived from petrochemical and crude oil refining waste products, and more particularly, this invention relates to the suspension of substantial amounts of solids in fuels while maintaining viscosity and fuel value specifications.

BACKGROUND OF THE INVENTION

Hazardous waste disposal has become more difficult as stricter solid waste disposal and air emissions standards have been implemented. In petrochemical and crude oil refining, both liquid wastes and solid wastes are generated which must be safely and economically treated to alleviate the hazards associated with the waste streams. Since there is often an inherent fuel value associated with many refinery wastes streams, disposal procedures have been developed to burn such waste stream fuels in furnaces and kilns in order to recover the fuel value, while reducing both the nature and volume of the waste stream from large volumes of complex organic molecules to simple carbon dioxide and water combustion products. This form of waste utilization reduces the volume of the original waste stream. It also degrades the hazardous molecules to environmentally acceptable products.

The disposal of solid waste products generated during petroleum refining poses an even more challenging opportunity. These solid wastes are diverse, having been generated in filtering, reactor processing and settling process steps. Sometimes, the solids are metal salts requiring special disposal techniques. Often, these solid materials are coated or infiltrated with hydrocarbon molecules, making their disposal more complex, and their retention in hazardous waste disposal sites expensive.

The present invention provides fuel compositions and methods of making such fuels whereby certain refinery waste streams having adequate fuel value are advantageously combined with refinery solid wastes to obtain a fuel for use in cement kilns. The cement kiln provides a process environment in which high kiln temperatures insure adequate degradation of the heavy organic molecules. Simultaneously, the cement kiln provides a matrix of solid cement particles which are chemically compatible with the solid particles resulting from the refinery solid wastes so as to obtain an acceptable cement product.

Fuels made according to the present invention must meet several criteria in order to qualify as cement kiln fuels. The two most important specifications are that the fuel containing solids must be pumpable in varying outdoor temperatures, and it must provide adequate fuel value so that high temperatures can be maintained in the cement kiln. Both of these criteria are in conflict with the refiner's objective of disposing of the maximum mass of waste solids in the lowest fuel value stream. These disparate factors are satisfactorily resolved in the present invention which provides for fuels with high solids content and adequate fuel value for cement kiln applications.

SUMMARY OF THE INVENTION

The fuels of the present invention comprise at least four components: (i) a heavy paraffinic oil such as lube oil extract, heavy vacuum gas oil, combined fluidized bed catalytic cracking unit ("FCCU") and crude tank bottoms; (ii) an emulsified waste oil, e.g., American Petroleum Institute ("API") separator oil skimmings or desalter oily bleed to sewer; (iii) water from pond, sewer, sour condensate or various brines; and, (iv) solids from API separator belt press cake, storage tank bottoms, oily sewer sludge, or F037 or F038 (Federal EPA waste descriptor classifications defined in 40 C.F.R. ∫261.13(b) (2)) in the subsurface.

In order to meet the pumpability and fuel value criteria established for cement kiln operation, the fuel is comprised of the above components mixed in proportions which are related to the ambient temperature for transport, storage and consumption of the fuel. For ambient temperatures below 40° F., the fuel is mixed to obtain a heavy paraffinic oil content in the range of 10 to 45% by weight in the liquid phase, an emulsified waste oil content in the range of 40 to 85%, by weight, and added water content in the range of 0.1 to 20% by weight. For ambient temperatures in excess of 40° F., the fuel may be blended in different proportions: heavy paraffinic oil content in the liquid phase of 25 to 80% by weight, an emulsified waste oil content in the range of 5 to 50% by weight, and added water content in the range of 0.1to 25% by weight. In both fuels, it is possible to add up to 70% solids by weight of the entire fuel mixture. The solids content will be determined by reference to the minimum fuel value and viscosity. The resulting fuels should have a viscosity of 1000 to 4000 cps at 76° F., a density of 8.2 to 8.9 pounds/gallon, high lubricity, 6 to 14% weight ash, and a fuel value in excess of 10,000 BTU/lb. The resulting fuels are characterized as thixotropic.

DETAILED DESCRIPTION OF THE INVENTION

Figure 1:
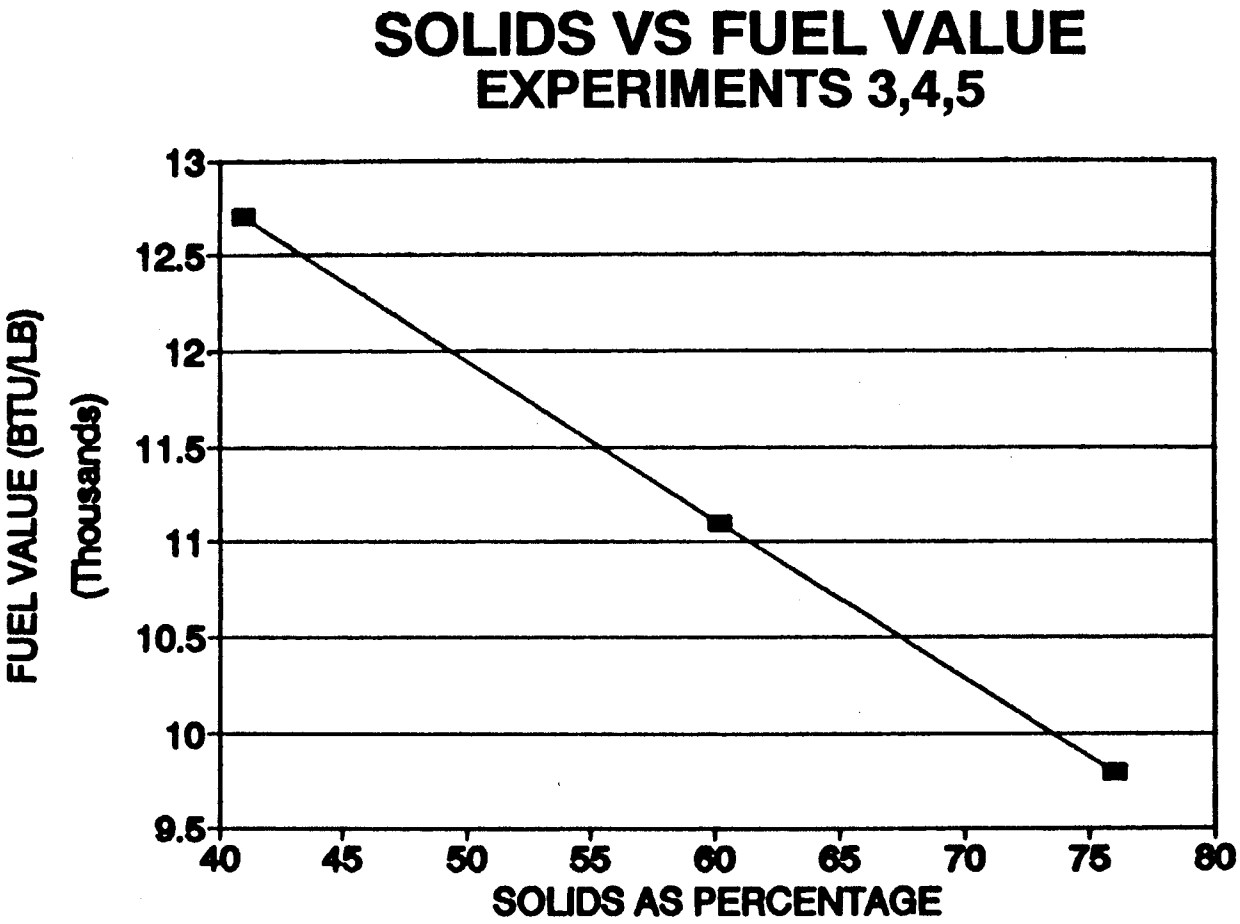
FIG. 1 is a plot of fuel value as a function of solids content for fuels according to the present invention.

The heavy paraffinic oil component of the fuel typically has an average pour point of 80° F., an average density of 7.8 lbs./gallon, Basic Sediment and Water ("BS & W") less than 0.1% total, an asphaltene content below 10% and an API Gravity in the range of 12° to 18°. Common refinery sources of the heavy paraffinic oil component include lube oil extract, heavy vacuum gas oil, combined FCCU feed, and crude tank bottoms. Other sources are possible.

The emulsified waste oil component of the fuel is characterized by an average pour point less than 10° F., a density of about 6.8 lbs./gallon, BS & W in the range of 0.5 to 5.0%, and API Gravity in the range of 36° to 42° API. The emulsified waste oil component can be obtained from API separator oil skimmings and desalter oily bleed to sewer. Other sources are possible depending upon refinery operating conditions.

The solid component of the fuel can be obtained from diverse sources such as API separator belt press cake, storage tank bottoms, oily sewer sludge and F0376 and F038 in the subsurface. Additional refinery solids sources include K-waste (a Federal EPA waste descriptor classification defined in 40 C.F.R. §261.13(b) (2)), attapulgite filtration clays for kerosine, Jet A, JP-4, JP-5, coalescing beds, sand beds or other materials formed at polar and non-polar boundaries typified by oil-water emulsion boundaries. The solids are typically one or more of sands, silts, $SiO_2$, alkali metal salts, alkali earth metal salts, ferrous sulfide, cupric sulfide, ferrous oxide, ferric oxide, metal carbonates, sulfates, chlorides and other halides. Solid particle size is typically in the range of 10μ to 5000μ.

It is also desirable that the solid particles are oil impregnated on their surface prior to their addition to the fuel. We have noted that diesel and kerosene coated solids do not suspend as well as those solids coated with higher boiling constituents. If the solids are not already associated with a stream containing water, it is advisable to test the solids for the presence of hydrophilic sites which will react with the water component of the fuel. These hydrophilic sites can be determined by thoroughly dispersing 100 grams of the solids in 100 grams of xylene or tetradecane through vigorous mixing. An observable increase in the viscosity of the solution or any agglomeration of the particulates when adding successive 1 ml aliquots of water up to 200 ml is indicative of the desired hydrophilic sites.

Before blending the components to obtain a fuel, it is first necessary to pre-select a desired final viscosity related to the ambient environment in which the fuel will be transported, stored and consumed. Once this selection has been made, the heavy paraffinic oil component and the emulsified waste oil component can be blended together in the proportions set forth above. Generally, for fuels to be used at temperatures above 40° F., the heavy paraffinic oil component is added in higher amounts than the emulsified waste oil component. Conversely, for fuels to be used at temperatures lower than (40° F.), the heavy paraffinic oil component is added in proportionately smaller amounts. The ideal mixing temperature for combining the two oil components is below 45° C. We have obtained satisfactory results when these two components have been blended together at 30° C. At higher temperatures, the heavy oil coating will strip off of the solids making it difficult to suspend them in the fuel. This high temperature separation is apparent when the surface of the finished fuel blend appears to be sandy or granular when agitated.

After the heavy paraffinic oil and emulsified waste oil have been blended together, it is preferred to add the solids next. Then, the addition of water into the fuel disperses the solids in a manner consistent with micelle formation. Accordingly, the solids are distributed evenly in the final fuel. If the solids contain sufficient water, it may not be necessary to add any more to the fuel. It is preferred to wait until the solids have been dispersed throughout the fuel and it appears homogeneous, before determining whether to add more water.

In the proper temperature range, solids addition will quickly cause the fuel to appear waxy or gelatinous. This effect becomes more pronounced as the weight percent of solids exceeds 30%. The waxes coming out of solution do not have the normal amorphous look of solid wax. Here, the appearance is consistent with nucleation on the surface of the suspended solids rather than the typical intermolecular Van Der Waals attractions.

If the water concentration is too low, an initial wax formation is obtained with solids addition. Within ten to fifteen minutes after solids addition, the solids will destabilize and settle to the bottom of the process vessel. This solids destabilization can be reversed by increasing the water concentration to the proper level.

Low shear mixing is preferred over high shear mixing. The waxes, once out of solution, do not tolerate high shear.

If the mixing equipment has power sensing capabilities, or if a viscometer is used, the thixotropic nature of the fuel may now be observed. We have obtained superior results by progressively increasing the mixing speed until mixer tip velocities exceed 12 miles per hour (using a Fawcett Mixed Flow Impeller marked with U.S. Pat. No. 2,787,448.)

We have observed an interesting phenomena with respect to the relationship between fuel viscosity and the amount of water added to the fuel. Added water is, in this instance, distinguished from intrinsic water which is introduced to the system through its association with the other fuel components. Our observations indicate that following an initial viscosity maxima just beyond the viscosity at zero water added, the viscosity decreases to a minima below the fuel viscosity with zero water added. This means that the addition of water to the fuel beyond the maxima will cause a decrease in viscosity and thus makes the fuel more pumpable. At some point beyond this minima the addition of water will cause gel formation, and the undesirable breakdown of the fuel suspension into non-homogeneous gel clumps. We are presently investigating this phenomena more thoroughly to quantify this relationship between viscosity and water added.

We have also developed additives which may be added to the blended thixotropic fuel in order to minimize oil-water phase separation during storage and to enhance total combustion of all hydrocarbon components in the fuel. The enhanced combustion additive may be important when this fuel is burned as a fuel in cement kilns in order to reduce or eliminate the total hydrocarbon content of the cement kiln stack gases. Another component called the carbon monoxide combustion promotor may be added to reduce or control carbon monoxide levels resulting from inefficient fuel combustion and the naturally high alkaline (calcium carbonate) content of the raw material feed to the cement kiln.

Alphaolefin sulfonates and other surface active dispersants can be used as additives for minimizing oil water phase separation and for enhancing solids dispersion and stabilization within the fuel.

Overbase magnesium oxide compounds can be added as the combustion enhancer to insure complete combustion of the hydrocarbon fuel. This additive helps to reduce or eliminate the hydrocarbon content of cement kiln stack gases.

A precious metal oxide is used as an additive to promote the combustion of carbon monoxide which may result from incomplete combustion of the cement kiln fuel. Some representative catalysts for this purpose include $PtO_2$ and $PtO_2/ReO_2$.

The present invention will now be described with reference to working examples.

EXAMPLES 1 THROUGH 10

A series of fuels were made according to the present invention using lube oil from Sun Refining and Marketing Company, Tulsa, Oklahoma. The lube oil was characterized by 85° F. pour point, density of 0.92 g/cm$^3$, no BS & W concentration, and no asphaltene concentration. The fuel included emulsified waste oil having 0.85 g/cm³ density, 0.5% BS & W, 35.3 API Gravity, and also included water and belt press cake. The cake included particles in the 50μ to 5000μ range and were oil impregnated. These components were blended together in a specific order. The heavy paraffinic oil ("heavy") and emulsified allowed to cool to 82.4° F. The solids were added quickly (complete in about two minutes) and mixed at 2000 rpms using a 48 mm Fawcett Mixed Flow Impeller for about twenty minutes or until the fuel was homogeneous. Mixing of the sample caused an initial temperature rise to 86° F. for all samples except Experiment 4 which rose to 94° F. If the sample required water, it was added after the fuel appeared homogeneous. Total sample mass was 500 to 700 grams. All samples were mixed for forty additional minutes or until homogeneous whichever was longer. Temperatures were adjusted by ice bath when necessary.

After the fuels were mixed, samples were subjected to bomb calorimetry (ASTM Method D 240-87) and viscosity measurement using a Brookfield Model LVF with #2 spindle at 6 rpms.

The results of these tests are shown in Tables 1 and 2.

TABLE 1

| | EXPERIMENT 1 | | EXPERIMENT 2 | | EXPERIMENT 3 | | EXPERIMENT 4 | | EXPERIMENT 5 | |
|---|---|---|---|---|---|---|---|---|---|---|
| COMPONENTS | WT % TOTAL | LIQ. | WT % TOTAL | LIQ. | WT % TOTAL | LIQ. | WT % TOTAL | LIQ. | WT % TOTAL | LIQ. |
| HEAVY OIL | 22.5% | 41 | 10.2% | 17.3 | 45.5% | 77 | 30.7% | 77 | 18.5% | 77 |
| LIGHT OIL | 22.5% | 41 | 40.6% | 68.9 | 4.5% | 8 | 3.0% | 7.5 | 1.8% | 7.5 |
| WATER | 10.0% | 18 | 8.1% | 13.8 | 8.0% | 15 | 6.1% | 15.5 | 3.7% | 15.5 |
| SOLIDS | 45.0% | | 41.1% | | 41.0% | | 60.2% | | 76.0% | |
| FUEL VALUE BTU/LB | 11,600 | | 12,500 | | 12,700 | | 11,100 | | 9.800 | |
| VISCOSITY | 3,000 cps | | 1,050 cps | | 2,000 cps | | 3,825 cps | | 3,700 cps | |
| TEMP OF FUEL AT VISCOSITY | 4° C. | | 4° C. | | 25° C. | | 25° C. | | 35° C. | |

TABLE 2

| | EXPERIMENT 6 | | EXPERIMENT 7 | | EXPERIMENT 8 | | EXPERIMENT 9 | | EXPERIMENT 10 | |
|---|---|---|---|---|---|---|---|---|---|---|
| COMPONENTS | WT % TOTAL | LIQ. | WT % TOTAL | LIQ. | WT % TOTAL | LIQ. | WT % TOTAL | LIQ. | WT % TOTAL | LIQ. |
| HEAVY OIL | 39.7% | 81.7 | 50.5% | 79.2 | 42.5% | 74.7 | 30.1% | 50.9 | 25.4% | 50.9 |
| LIGHT OIL | 8.9% | 18.3 | 13.2% | 20.8 | 11.1% | 19.5 | 15.2% | 25.5 | 12.9% | 25.7 |
| WATER | 0 | 0 | 0.0% | 0 | 3.3% | 5.8 | 13.8% | 23.6 | 11.7% | 23.4 |
| SOLIDS | 51.4% | | 36.3% | | 43.1% | | 40.9% | | 50.0% | |
| FUEL VALUE BTU/LB | 12,100 | | 14,900 | | 13,500 | | 11,900 | | 11,200 | |
| VISCOSITY | 1,050 cps | | 2,000 cps | | 4,000 cps | | 1,000 cps | | 1,200 cps | |
| TEMP OF FUEL AT VISCOSITY | 25° C. | | 25° C. | | 25° C. | | 25° C. | | 25° C. | |

The results as shown in Tables 1 and 2 illustrate that the four components when blended yield high-solids fuels of multiple viscosities with large BTU/lb. values. Experiments 1 and 2 shown that a stable low temperature fuel with variable flow characteristics may be made while solid suspension is above 40 percent and fuel value stays above 11,500 BUT/lb. Experiments 3, 4 and 5 (shown in Table 1 and FIG. 1) depict high solids concentrations for fuels with relatively constant liquid component ratios. Thus, higher viscosities may yield fuels of extraordinary solids concentrations with high BTU/lb. values. Experiments 6 and 7 demonstrate zero-water addition fuels which have high solids content, high BTU/lb. values and low viscosities. Experiments 8, 9 and 10 show the variety of compositions the fuels may achieve at room temperature. Experiment 8 fuel has a low water and high heavy oil content to yield a high viscosity, high solids, low water fuel. Experiments 9 and 10 show that more water and light oil yields high-solid fuels of excellent viscosity with only slight fuel value decreases.

While the foregoing invention has been described with reference to particularly preferred embodiments, these embodiments are not intended to limit the scope of the present invention, but instead are intended to illustrate the invention. Those of ordinary skill in the art will appreciate that variations and modifications to the embodiments described here are still within the scope of the present invention.

What is claimed is:

1. A fuel for use in combustion in a cement kiln which comprises:

a) a heavy paraffinic oil having an average pour point of 80° F., an average density of 7.8 lbs./gallon, less than 0.1% Basic Sediment & Water, less than 10% asphaltene content and an API gravity in the range of 12° to 18° API; and, b) an emulsified waste oil having a pour point less than 10° F., an average density of 6.8 lbs./gal., Basic Sediment & Water concentration in the range of 0.5 to 5.0%, and API Gravity in the range of 36° to 42° API:

c) solid particles constituting at least 36% of the weight of said fuel having particles sizes in the range of 10μ to 5000μ and oil impregnated on the surface of said particles wherein said components are mixed together such that the suspended solids are stably suspended in the resulting fuel, the resulting fuel has a viscosity of 1000–4000 cps at 25° C; and the resulting fuel has a fuel value in excess of 8000 BUT/lb.

2. A fuel according to claim 1 wherein said heavy paraffinic oil is selected from the group consisting of lube oil extract, heavy vacuum gas oil, combined fluidized bed catalytic cracking unit feed, crude oil tank bottoms, and mixtures thereof.

3. A fuel according to claim 1 wherein said emulsified waste oil is selected from the group consisting of American Petroleum Institute separator oil skimming stream, desalter oily bleed to sewer stream, and mixtures thereof.

4. A fuel according to claim 1 wherein said solids are selected from the group consisting of API separator belt press cake, storage tank bottoms, oily sewer sludge, F037 and F038 classified wastes, and mixtures thereof.

5. A fuel according to claim 1 wherein said solids are selected from the group consisting of K-waste, attapulgite filtration clays, sands, silts, $SiO_2$, alkali metal salts, alkaline earth metal salts, ferric sulfide, cupric sulfide, ferrous oxide, metal carbonates, metal sulfates, metal chlorides, and mixtures thereof.

6. A fuel according to claim 1, further comprising water.

7. A fuel according to claim 6 for use at ambient temperatures below 40° F. wherein said fuel liquid phase components are present:

heavy paraffinic oil in the range of 10 to 45% by weight of the liquid phase;

emulsified waste oil in the range of 40 to 85% by weight of the liquid phase;

emulsified waste oil in the range of 40 to 85% by weight of the liquid phase; and, water in the range of 0.1 to 20% by weight of the liquid phase.

8. A fuel according to claim 6 for use at ambient temperatures above 40° F. wherein said fuel liquid phase components are present:

heavy paraffinic oil in the range of 25 to 80% by weight of the liquid phase;

emulsified waste oil in the range of 5 to 50% by weight of the liquid phase; and, water in the range of 0.1 to 25% by weight of the liquid phase.

9. A method of disposing of refinery wastes which comprises the steps of:

blending a cement kiln fuel having a heavy paraffinic oil component, an emulsified waste oil component, a water component and a solids component to obtain a fuel which can be pumped and which has a fuel value in excess of 8000 BUT/lb.;

burning said cement kiln fuel in a cement kiln to obtain a cement product, carbon dioxide and water emissions.

* * * * *